US005752854A

United States Patent [19]

Capp et al.

[11] Patent Number: 5,752,854

[45] Date of Patent: May 19, 1998

[54] PANEL MOUNT STRUCTURE

[75] Inventors: Randolph E. Capp, Camp Hill; Michael W. Fogg, Harrisburg; Leroy Jack Morningstar, Middleton; James Stanley Staron, Halifax, all of Pa.

[73] Assignee: The Whitaker Corporation, Wilmington, Del.

[21] Appl. No.: 801,279

[22] Filed: Feb. 18, 1997

[51] Int. Cl.[6] ..... H01R 13/648

[52] U.S. Cl. ..... 439/607; 439/939

[58] Field of Search ..... 439/607, 608, 439/610, 939

[56] References Cited

U.S. PATENT DOCUMENTS

| | | | |
|---|---|---|---|
| 4,386,814 | 6/1983 | Asick . | |
| 4,571,012 | 2/1986 | Bassler et al. . | |
| 4,738,637 | 4/1988 | Asick et al. | 439/610 |
| 4,808,125 | 2/1989 | Waters et al. | 439/607 |
| 4,824,377 | 4/1989 | De Burro | 439/607 X |
| 4,854,890 | 8/1989 | Nishimura | 439/607 |
| 4,889,502 | 12/1989 | Althouse et al. | 439/607 |
| 4,906,208 | 3/1990 | Nakamura et al. | 439/607 OR |
| 4,938,704 | 7/1990 | Fijura | 439/95 |
| 5,037,331 | 8/1991 | Goodman et al. | 439/607 |
| 5,317,105 | 5/1994 | Weber | 174/35 GC |
| 5,603,639 | 2/1997 | Lai et al. | 439/607 OR |

*Primary Examiner*—Neil Abrams
*Assistant Examiner*—Daniel Wittels
*Attorney, Agent, or Firm*—Gerald K. Kita

[57] ABSTRACT

A conducting flange (1) for an electrical connector (3) is constructed with, spaced apart points of attachment (14) of the flange (1) to a panel, and multiple bumps (15, 16, 17, 18, 19, 20) on the flange (1) to concentrate pressure between the flange (1) and a panel. The bumps (15, 16, 17, 18, 19, 20) have progressively increased heights as their respective distances increase from a closest of said points of attachment (14) to compensate for corresponding decreases in pressure contact between the flange (1) and the panel.

14 Claims, 5 Drawing Sheets

PANEL MOUNT STRUCTURE

FIELD OF THE INVENTION

The invention relates to a panel mount structure for an electrical connector, and, more particularly, to a flange for an electrical connector that establishes electrical connection with a panel for EMI/RFI shielding.

BACKGROUND OF THE INVENTION

A known flange for an electrical connector is disclosed in U.S. Pat. No. 5,037,331. The known flange is bent in a wave-like form to establish pressure contact with a die cast metal shell. The metal shell itself has a flange with spaced apart openings, which can be used as points of attachment, for example, to attach the metal shell to a panel. The flange impinges the metal shell to establish an electrical connection. The electrical connection establishes a ground path for shunting EMI/RFI induced voltage. Such an electrical connection is established by pressure contact between the flange on the metal shell and the panel. The pressure contact is adequate near the connection points, where the flange is attached to the panel. However, the pressure contact substantially dissipates with distance from the connection points. The lack of pressure contact with the panel lessens effective shunting of EMI/RFI induced voltage. It would be desirable to provide multiple points of pressure contact that are distributed along a conducting flange for an electrical connector, to effectively shunt EMI/RFI induced voltages.

SUMMARY OF THE INVENTION

According to the invention, a conducting flange for an electrical connector has spaced apart points of attachment of the flange to a panel. Multiple bumps on the flange concentrate pressure between the flange and a panel. It has been found that the bumps provide multiple points of pressure contact between the flange and the panel, and compensate for dissipation of the pressure contact with distance from the points of attachment of the flange to a panel.

According to the invention, a conducting flange for an electrical connector has spaced apart points of attachment of the flange to a panel, and multiple bumps on the flange to concentrate pressure between the flange and a panel, the bumps having progressively increased heights as their respective distances increase from a closest of said points of attachment. Thus, as differential reductions in pressure occur at increased distances from the points of attachment, the bumps increase in height to compensate for such differential reductions in pressure.

According to a further embodiment of the invention, the bumps at equal distances from respective closest points of attachment have the same heights. Thus, pressure is divided more evenly among the multiple bumps when at least some of the bumps are at such equal distances.

According to a further embodiment of the invention, the flange is located on a conducting shell for an electrical connector. According to a further embodiment of the invention, the flange is located on a bracket for an electrical connector.

Embodiments of the invention will now be described by way of example with reference to the accompanying drawings, according to which:

DETAILED DESCRIPTION

Figure 7:
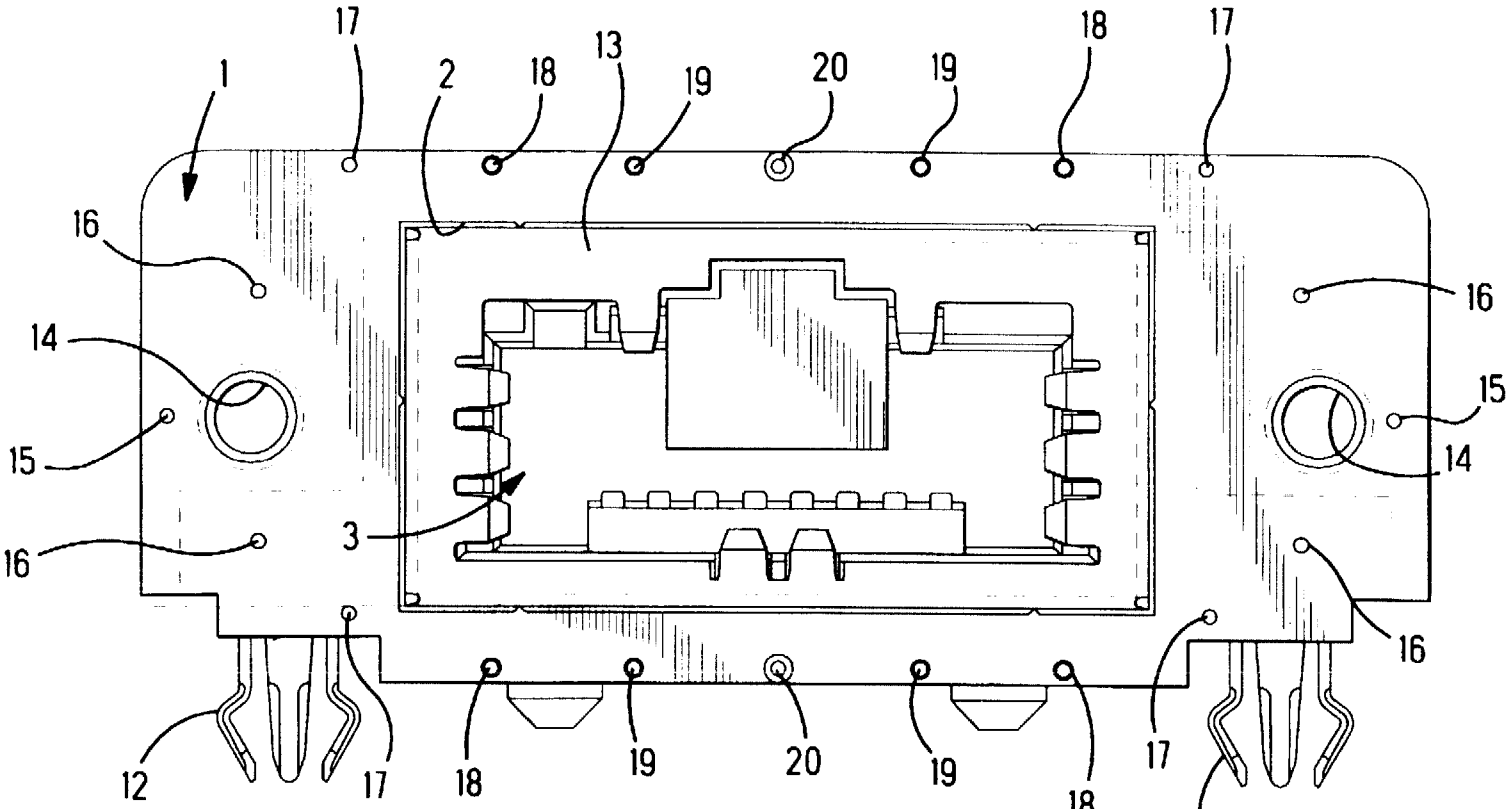
FIG. 7 is an enlarged front view of another flange and bracket.

With reference to FIGS. 1–7, a flange 1 for at least one electrical connector 2 is in the form of a die cast metal, such as zinc, plated with copper alloy over nickel alloy. The flange 1 has at least one corresponding opening 2 for encircling a corresponding electrical connector 3. In FIGS. 1–4, two openings 2 are disclosed. The flange 1 can also have one opening 2, as shown in FIG. 7. Each electrical connector 3 comprises, an insulating housing 4 with multiple electrical contacts 5 mounted by the housing. Further details of the electrical connector 3 are described in U.S. Pat. No. 4,808,125. For example, as in FIGS. 1–7, a back side 6 of the flange 1 has multiple fingers 7 that straddle a corresponding connector 3 to comprise a bracket. A pair of mounting legs 10 extend from the back side 6, and are provided with openings 11 receiving depending board locks 12. The board locks 12 are fasteners to attach the mounting legs 10 to a circuit board, not shown. Further details of a board lock 12 are disclosed in U.S. Pat. No. 4,842,552.

With reference to FIGS. 3–7, a hollow conducting metal shell 13 surrounds the housing 4. The shell 13 is stamped and formed from sheet metal. The shell 13 enters a corresponding opening 2 in the flange 1, and registers frictionally with the flange 1, for example, as described in U.S. Pat. No. 4,808,125.

Figure 8:
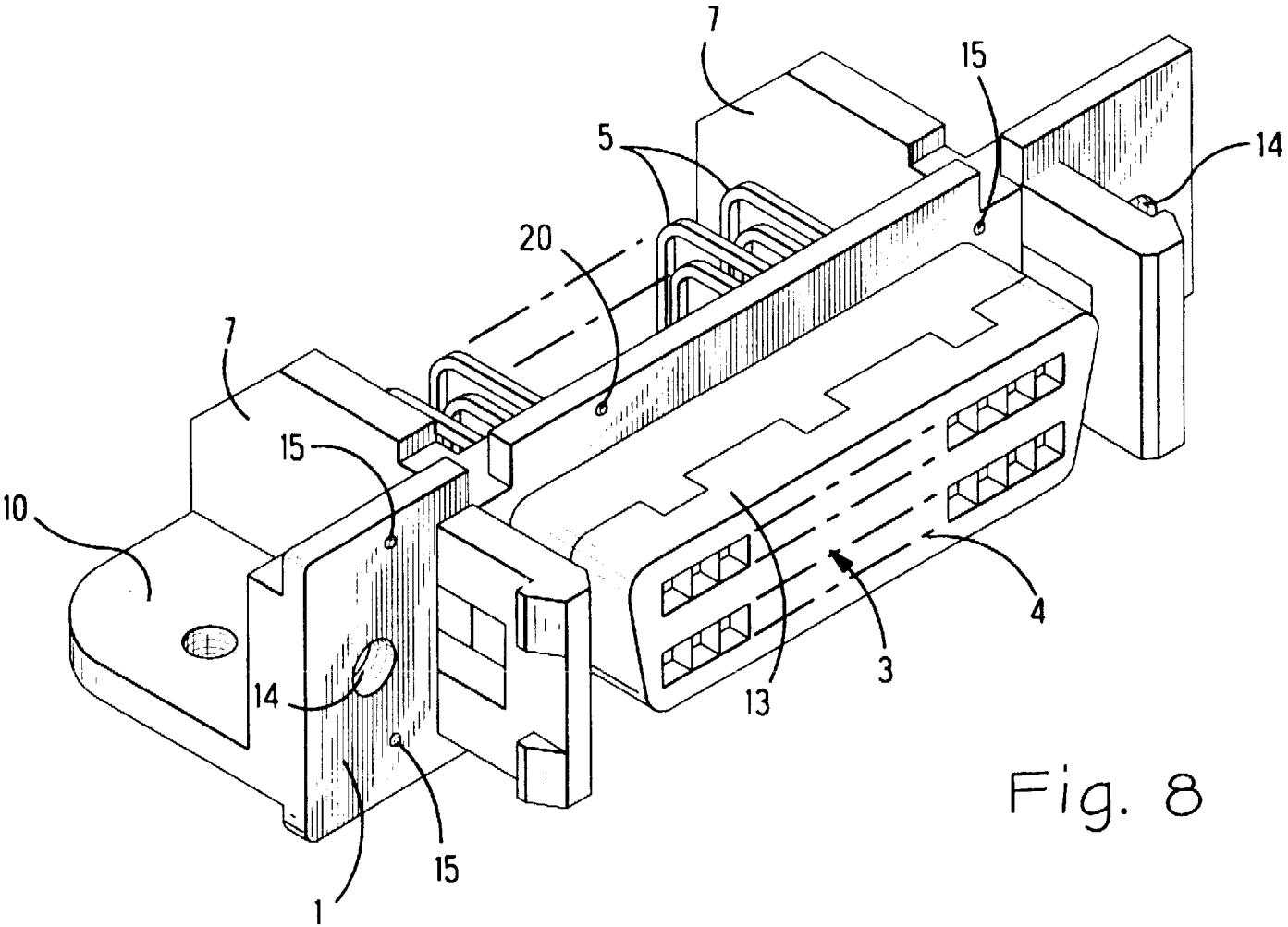
FIG. 8 is an isometric view of a flange on a cast metal shell for at least one electrical connector.
Figure 9:
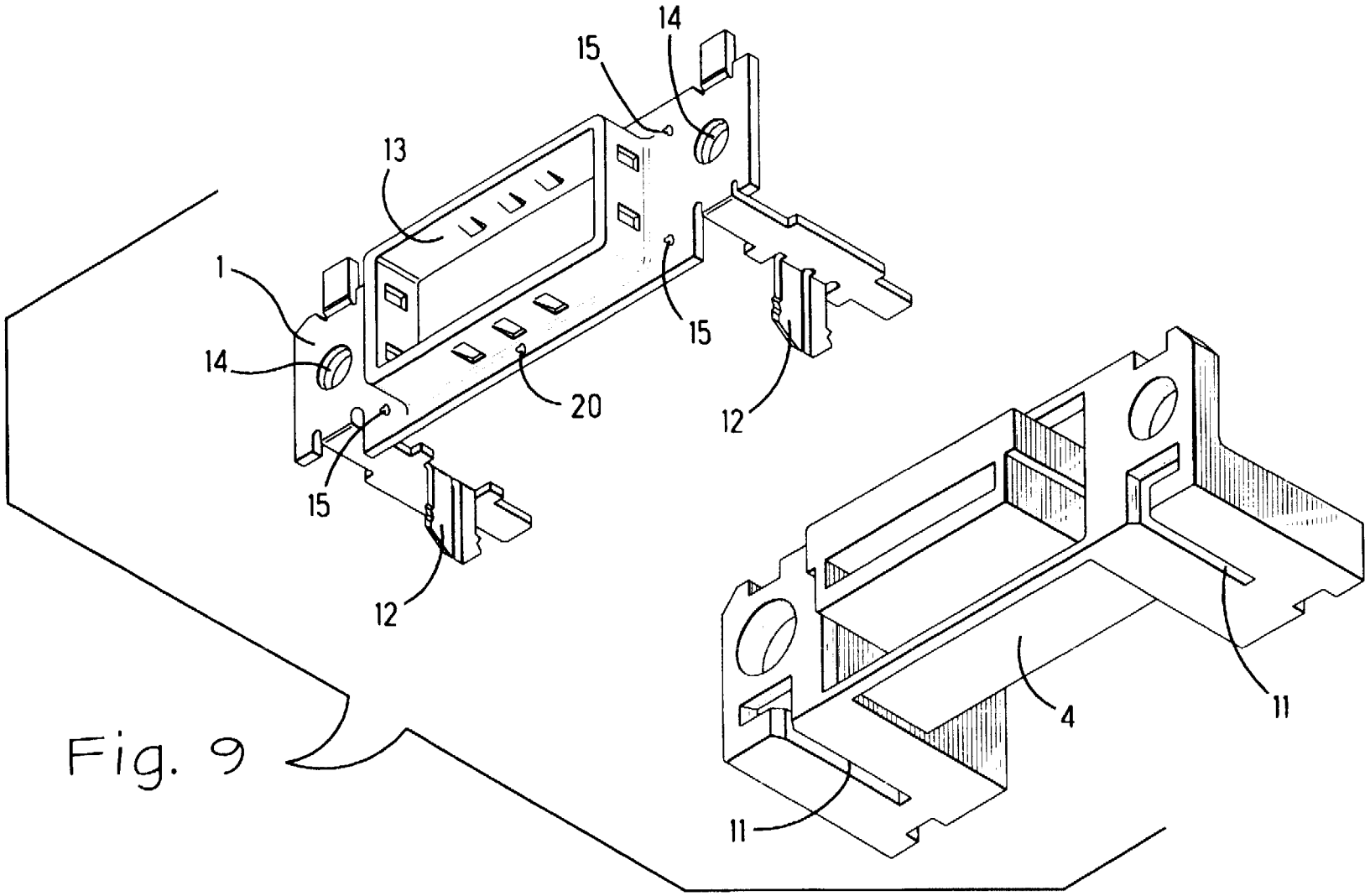
FIG. 9 is an isometric view of a flange on a conducting shell for at least one electrical connector, a housing of the electrical connector being shown separated from the shell.

With reference to FIGS. 8 and 9, the flange 1 is unitary with a hollow metal shell 13 for the connector. With reference to FIG. 8, the flange 1 is unitary with a hollow, cast metal shell 13 for the connector 3. With reference to FIG. 9, the flange 1 and the shell 13 are stamped and formed from a sheet of metal.

Figure 2:
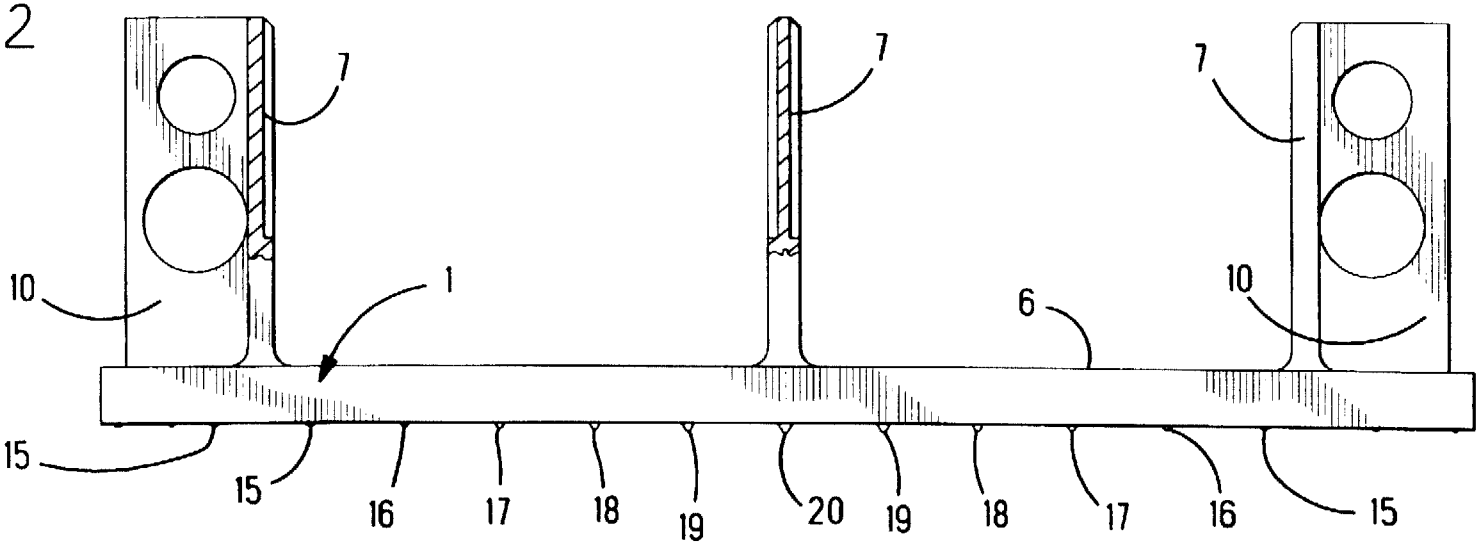
FIG. 2 is a top view of the flange and bracket, as shown in FIG. 1.
Figure 1:
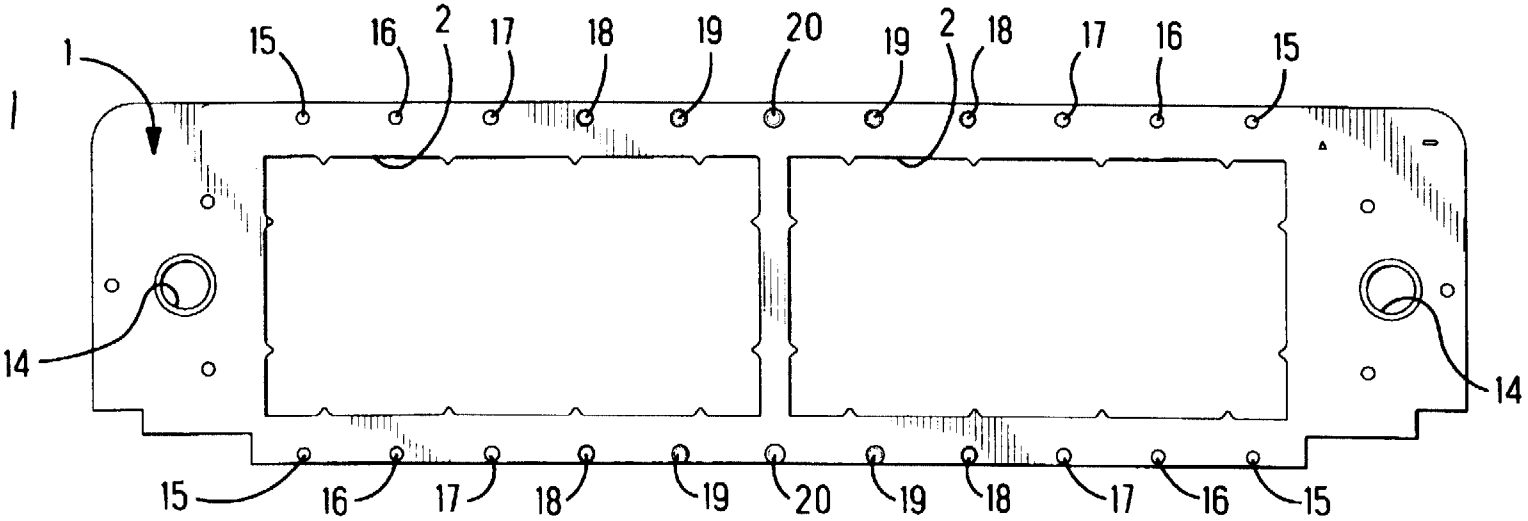
FIG. 1 is an enlarged front view of a flange for electrical connectors, the flange being on a bracket.
Figure 6:
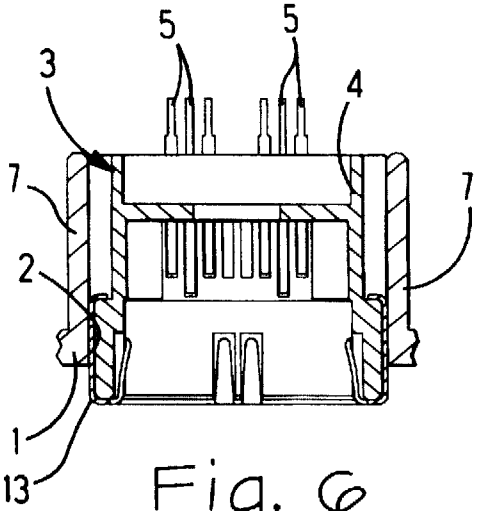
FIG. 6 is a section view taken along line 6—6 of FIG. 3.
Figure 5:
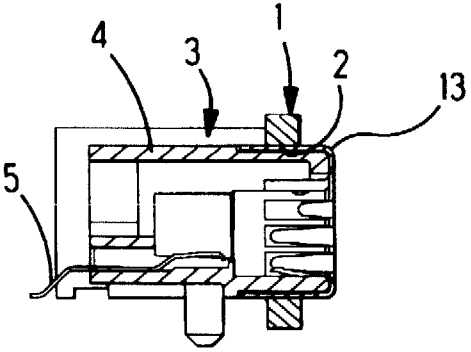
FIG. 5 is a section view taken along line 5—5 of FIG. 3.
Figure 4:
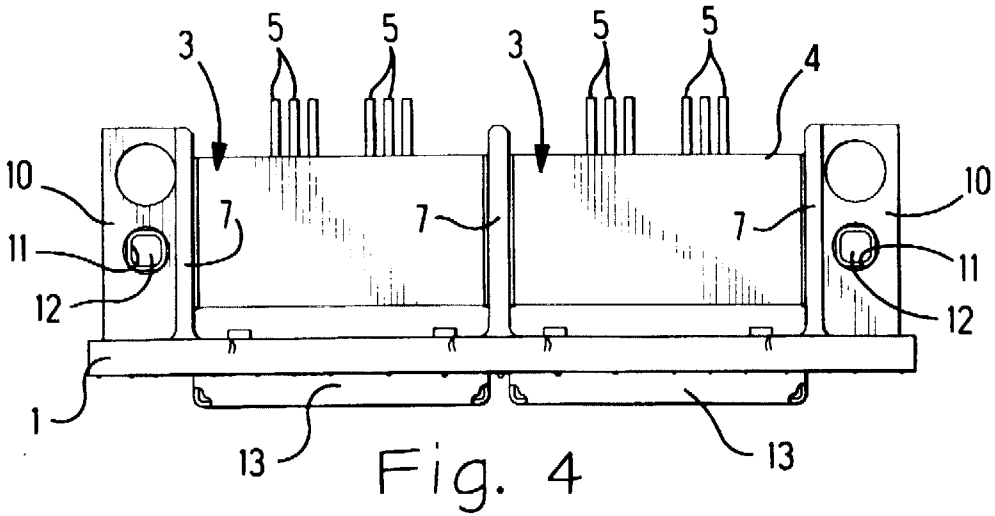
FIG. 4 is a top view of the structure as shown in FIG. 3.
Figure 3:
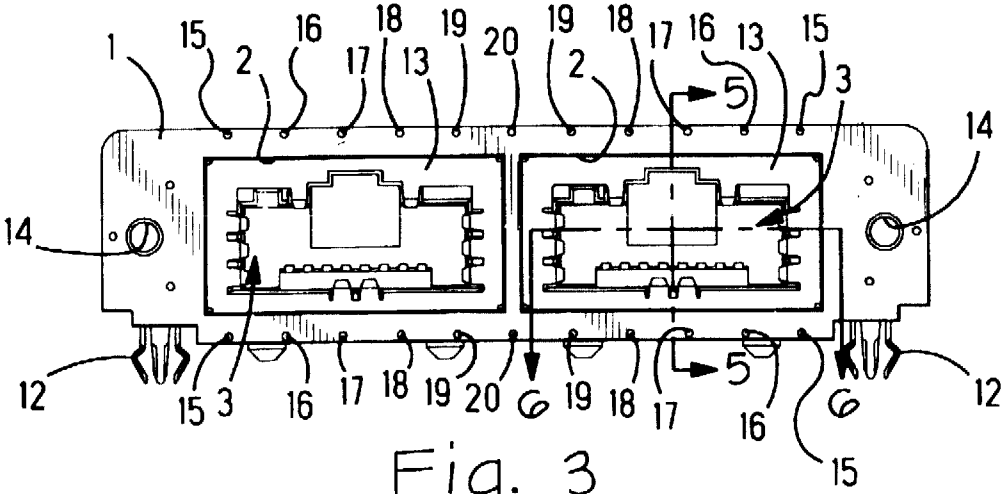
FIG. 3 is a front view of the flange and bracket, as shown in FIG. 1, together with at least one electrical connector, and a second electrical connector.

With reference to FIGS. 1 and 2, for example, the flange 1 will now be described. Spaced apart openings through the flange 1 provide spaced apart, points of attachment 14 of the flange 1 to a conducting panel, not shown. For example, fasteners, such as common bolts, not shown, through the spaced apart openings that comprise the points of attachment 14, secure the flange 1 by its points of attachment 14 to a conducting panel.

Electrical contact between the flange 1 and a conducting panel is relied upon for shunting EMI/RFI induced voltages on the shell 13 and the flange 1. Reliable pressure contact between the flange 1 and the panel is desired. In the past, the points of attachment 14 were relied upon to secure the flange 1 to the panel, as well as, to establish pressure contact between the flange 1 and the panel. It has been found that the pressure contact accumulates near the points of attachment 14, and dissipates with distance from the points of attachment 14. Dissipation of pressure can be due to unevenness of the abutting surfaces, for example. The lack of pressure contact prevents effective electrical connection between the flange 1 and the panel, except near the points of attachment 14, which are widely spaced apart. As a consequence, EMI/RFI induced voltages are shunted by conduction paths that become lengthy until they reach the widely spaced apart pressure contact points between the flange 1 and the panel.

The invention provides multiple pressure contact points distributed along the flange 1. With reference to FIGS. 1 and 2, the conducting flange 1 is provided with multiple bumps 15, 16, 17, 18, 19, 20 on the flange 1 to concentrate pressure between the flange 1 and a panel, the bumps 15, 16, 17, 18, 19, 20 having progressively increased heights as their respective distances increase from a closest of said points of attachment 14. Differential reductions in pressure contact would have occurred without the bumps 15, 16, 17, 18, 19, 20 at increased distances from the points of attachment 14. The bumps 15, 16, 17, 18, 19, 20 increase in height differentially to compensate for such differential reductions in pressure contact. For each bump 15, 16, 17, 18, 19, 20, the distance from the closest point of attachment determines the height of each of the bumps 15, 16, 17, 18, 19, 20, relative to the heights of other bumps 15, 16, 17, 18, 19, 20 that are farther away. The bumps 15, 16, 17, 18, 19, 20 progressively increase in their respective distances from a closest of said points of attachment 14. The bumps 15, 16, 17, 18, 19, 20 have progressively increased heights. Accordingly, the bumps 15, 16, 17, 18, 19, 20 have progressively increased heights as their respective distances increase from a closest of said points of attachment 14. For example, the bumps 15 that are closest to respective, closest points of attachment have the same height of 0.127 inch. The bumps 20 that are farthest from respective, closest points of attachment 14 have the same height of 0.406 inch. For example, the bumps 15, 16, 17, 18, 19, 20 are die cast together with the flange 1, FIGS. 3, and 5. Further, for example, the bumps 15, 16, 17, 18, 19, 20 can be raised embossments on a stamped and formed flange 1, FIG. 6.

According to a further embodiment of the invention, the bumps 15, 16, 17, 18, 19, 20 that at equal distances from respective closest points of attachment 14 have the same heights. Thus, pressure is divided more evenly among the multiple bumps 15, 16, 17, 18, 19, 20 when at least some of the bumps 15, 16, 17, 18, 19, 20 are at equal distances and have the same heights. For example, the bumps 15, 16, 17, 18, 19, 20 that are identified by the same numerals in FIGS. 1 and 2 are at equal respective distances from respective, closest points of attachment 14, and, accordingly, have the same heights.

Although preferred embodiments of the invention have been disclosed, other embodiments and modifications of the invention are intended to be covered by the spirit and scope of the appended claims.

What is claimed is:

1. A conducting flange 1 for an electrical connector comprises: spaced apart points of attachment of the flange to a panel, the spaced apart points of attachment being on the flange, and multiple bumps on the flange to concentrate pressure between the flange and a panel, the bumps having progressively increased heights as their respective distances increase from a closest of said points of attachment to compensate for corresponding decreases in pressure contact between the flange and the panel.

2. A conducting flange for an electrical connector as recited in claim 1 wherein, the flange is unitary with a conducting hollow shell.

3. A conducting flange for an electrical connector as recited in claim 1, and further comprising:

a conducting hollow shell, and the flange frictionally engages the shell.

4. A conducting flange for an electrical connector as recited in claim 1 wherein, the spaced apart points of attachment comprise fastener receiving openings through the flange.

5. A conducting flange for an electrical connector as recited in claim 1 wherein, the flange is on a bracket.

6. A conducting flange for an electrical connector as recited in claim 1 wherein, the bumps are die cast together with the flange.

7. A conducting flange for an electrical connector as recited in claim 1 wherein, the bumps being at equal said respective distances from a closest of said points of attachment have the same heights.

8. An electrical connector comprising: at least one insulating housing, electrical contacts mounted in the housing, a conducting flange at least partially surrounding the housing, spaced apart points of attachment of the flange to a panel, the spaced apart points of attachment being on the flange, multiple conducting bumps on the flange to concentrate pressure between the flange and a panel, the bumps having progressively increased heights as their respective distances increase from a closest of said points of attachment.

9. An electrical connector as recited in claim 8 wherein, the flange is metal, and the connector is received in an opening in the flange.

10. An electrical connector as recited in claim 8 wherein, the flange is on a hollow metal shell, and the metal shell surrounds the housing.

11. An electrical connector as recited in claim 8 wherein, the spaced apart points of attachment comprise fastener receiving openings through the flange.

12. An electrical connector as recited in claim 8 wherein, the flange is on a bracket.

13. An electrical connector as recited in claim 8 wherein, the bumps are die cast together with the flange.

14. An electrical connector as recited in claim 8 wherein, the bumps being at equal said respective distances from a closest of said points of attachment have the same heights.

* * * * *